US005243948A

United States Patent [19]

Schnaibel et al.

[11] Patent Number: 5,243,948

[45] Date of Patent: Sep. 14, 1993

[54] ELECTRONIC CONTROL SYSTEM FOR FUEL METERING IN AN INTERNAL COMBUSTION ENGINE

[75] Inventors: Eberhard Schnaibel, Hemmingen; Rudi Mayer, Vaihingen/Enz; Thomas Gölzer, Schwieberdingen; Bernhard Ebinger, Stuttgart; Dieter Schuler, Sindelfingen, all of Fed. Rep. of Germany

[73] Assignee: Robert Bosch GmbH, Stuttgart, Fed. Rep. of Germany

[21] Appl. No.: 852,256

[22] PCT Filed: Oct. 12, 1990

[86] PCT No.: PCT/DE90/00774

§ 371 Date: Jun. 1, 1992

§ 102(e) Date: Jun. 1, 1992

[87] PCT Pub. No.: WO91/08390

PCT Pub. Date: Jun. 13, 1991

[30] Foreign Application Priority Data

Nov. 30, 1989 [DE] Fed. Rep. of Germany ..... 3939548

[51] Int. Cl.[5] ..... F02D 41/10; F02D 41/12; F02D 41/32; F02B 75/10

[52] U.S. Cl. ..... 123/492; 123/493

[58] Field of Search ..... 123/478, 480, 492, 493

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,852,538 | 8/1989 | Nagaishi | 123/492 |
| 4,893,602 | 1/1990 | Gross et al. | 123/492 |
| 4,903,668 | 2/1990 | Ohata | 123/478 |
| 4,919,094 | 4/1990 | Manaka et al. | 123/493 X |
| 4,939,658 | 7/1990 | Sekozawa et al. | 123/480 X |
| 4,953,530 | 9/1990 | Manaka et al. | 123/492 X |

FOREIGN PATENT DOCUMENTS

| | | |
|---|---|---|
| 0046599 | 3/1982 | European Pat. Off. . |
| 0258837 | 3/1988 | European Pat. Off. . |
| 3042246 | 6/1982 | Fed. Rep. of Germany . |
| 3636810 | 4/1987 | Fed. Rep. of Germany . |
| 3623041 | 1/1988 | Fed. Rep. of Germany . |
| 21185592 | 7/1987 | United Kingdom . |

*Primary Examiner*—Willis R. Wolfe
*Attorney, Agent, or Firm*—Kenyon & Kenyon

[57] ABSTRACT

An electronic control system for fuel metering in an internal combustion engine includes, inter alia, means for determining a basic injection-quantity signal and a transition compensation signal for adapting the quantity of fuel metered-in in the case of acceleration and deceleration, in which, for the purpose of transition compensation, a wall-film quantity signal and a discharge factor signal (Tk) are formed as a function of load and rotational speed, and the transition compensation signal takes into account both the wall-film quantity signal and the discharge factor signal. The discharge factor signal can either be read from a characteristic map or assume two discrete values. The proposed system serves the purpose of achieving a transitional behavior which is as optimum as possible with respect to the exhaust gas.

13 Claims, 5 Drawing Sheets

ELECTRONIC CONTROL SYSTEM FOR FUEL METERING IN AN INTERNAL COMBUSTION ENGINE

FIELD OF THE INVENTION

The present invention relates to an electronic control system for fuel metering in an internal combustion engine. More particularly, the present invention relates to a control system for fuel metering in an internal combustion engine with sensors for load, rotational speed, and temperature, and means for determining a basic injection-quantity signal and a transition compensation signal for adapting the fuel quantity metered-in, in the case of acceleration and deceleration.

BACKGROUND OF THE INVENTION

German Published Patent Application 3,042,246 and the corresponding U.S. Pat. No. 4,440,136 disclose a fuel metering system in which, for the purpose of acceleration enrichment, an enrichment factor is formed in accordance with a certain formula and the individual components of the formula can be called from memories as a function of load and rotational speed. The enrichment factor is given by FM=1+FM 1×FM 2. In this equation, FM 1 is rotational speed- and load-dependent and FM 2 is temperature-dependent.

German Published Patent Application 3,623,041 and the corresponding U.S. patent application Ser. No. 165,274, now U.S. Pat. No. 4,893,602 disclose a method for fuel metering in the case of acceleration, which takes account of the temporal relation between the occurrence of the acceleration demand signal and the intake valve times in order to allow the required additional quantity of fuel for implementing the acceleration demand to be metered-in in the best possible way with respect to time. For this purpose, provision is made inter alia, to divide the calculated additional quantity of fuel between a plurality of successive metering processes or to provide so-called interim injections.

The physical problem in acceleration enrichment is to make available the required additional quantity in the combustion chambers of the internal combustion engine themselves. This proves difficult, particularly at low temperatures, because part of the quantity of fuel metered into the induction pipe condenses on the walls of the induction pipe and is thus, in the final analysis, not immediately available for the actual combustion process. The fuel precipitating on the inside wall of the induction pipe forms a so-called wall film of fuel. It is dependent not only on the structural conditions but also, in particular, on the temperature, rotational speed, and load.

Since it is very difficult to control the build-up and dissipation of the wall film of fuel in the case of unsteady operating states of the internal combustion engine, various attempts to describe the wall film have already been published in the literature. A fundamental work on this subject can be found in SAE Paper 810494 "Transient A/F Control Characteristics of the 5 Liter Central Fuel Injection Engine" by C. F. Aquino.

It is the object of the present invention to provide an electronic control system for fuel metering in an internal combustion engine, in which an optimum transitional behavior with respect to the exhaust gas is achieved in the case of acceleration and deceleration processes.

SUMMARY OF THE INVENTION

The control system for fuel metering according to the present invention is distinguished by good exhaust gas characteristics in the transitional mode since a transition compensation signal for adapting the quantity of fuel metered-in, in the case of acceleration and deceleration, is processed as a function of operating parameters, taking into account a wall-film quantity difference signal and a discharge factor signal.

DETAILED DESCRIPTION OF THE INVENTION

Figure 1:
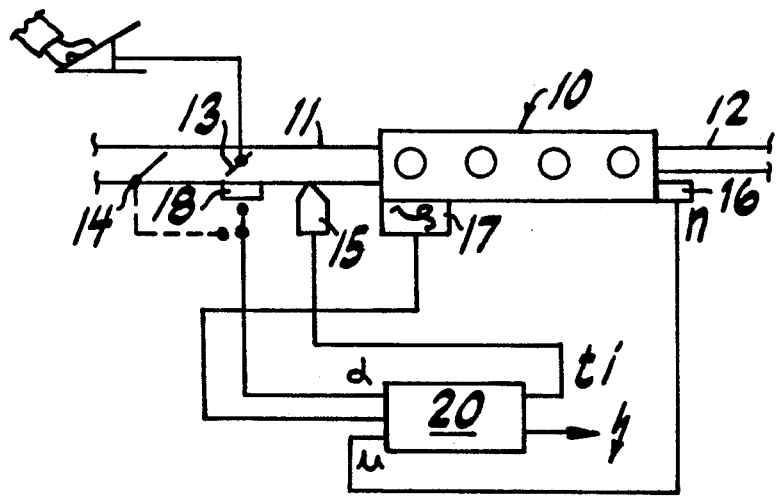
FIG. 1 is rough general diagram of the electronic control system of the present invention for fuel metering for an internal combustion engine.

FIG. 1 shows, in a rough overview, an internal combustion engine with its most important sensors, a control unit, and an injection valve. The internal combustion engine is here denoted by 10. It has an air induction pipe 11 and an exhaust pipe 12. In the air induction pipe 11 there is a throttle valve 13, if required an air flow or air mass meter 14, and an injection valve 15 for metering the required quantity of fuel into the air stream flowing to the internal combustion engine 10. A rotational speed sensor is denoted by 16 and a temperature sensor by 17. A load signal from a throttle-valve sensor 18 and/or from the air flow or air mass sensor 14 passes, together with the signals from the other sensors, to a control unit 20, which produces a control signal for the injection valve 15, of which there is at least one, and, if appropriate, an ignition signal and other control signals essential for the control of the internal combustion engine.

The basic structure, depicted in FIG. 1, of a fuel metering system for an internal combustion engine is known. The invention is concerned with the problem of preparing a transition compensation signal for the case of acceleration and deceleration, with the aim of the best possible transitional behavior of the internal combustion engine and of the vehicle equipped therewith, while simultaneously achieving as clean an exhaust gas as possible.

Figure 2:
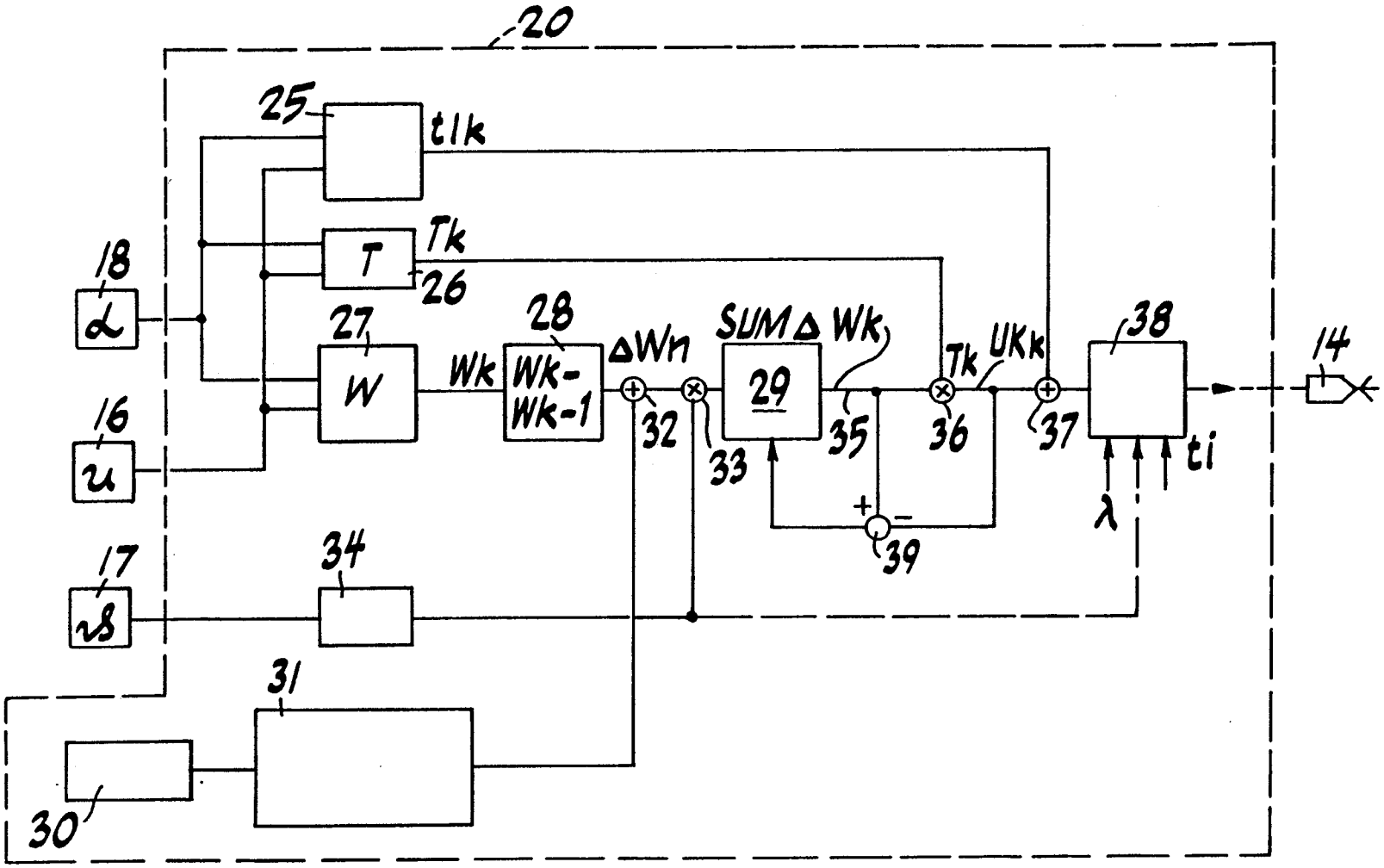
FIG. 2 is a block diagram of the primary elements of the electronic control system of the present invention for fuel metering with transition compensation.

A block diagram of the electronic control system according to the invention, for fuel metering, can be found in FIG. 2. There, those elements which are already familiar from FIG. 1 are provided with the reference symbols already mentioned.

Reference numeral 25 denotes a basic characteristic map for outputting a basic injection signal tlk. A discharge factor characteristic map for outputting a discharge factor signal Tk bears the reference symbol 26, and 27 denotes a wall-film quantity characteristic map for outputting a corresponding wall-film quantity signal Wk. All three characteristic maps, 25, 26 and 27, receive at their inputs, signals from the load sensor 18 and rotational speed sensor 16.

The wall-film quantity characteristic map 27 is followed by a difference-forming means for the formation of a difference signal $\Delta Wn = Wk - Wk - 1$ between successive wall-film quantity values.

A block 30 outputs a signal which marks the end of an overrun operation. A subsequent block 31 produces a correction signal TUKSAS as a function of the preceding duration of an overrun phase. A summing point 32 subsequently combines the output signals of the two blocks 28 and 31.

A multiplication point 33 follows summing point 32. At multiplication point 33, the output signal of the summing point 32 is multiplied by a temperature-dependent signal from a block 34, which is in turn connected to the temperature sensor 17. The result is then a wall-film alteration signal $\Delta Wn$ corrected as a function of temperature and operation duration.

In a subsequent block 29, the instantaneous alteration signal $\Delta Wn$ has added to it the not yet injected remainder of all preceding difference formations SUM $\Delta Wk$-1, with the result that a signal SUM $\Delta Wk = Wk$ $Wk - 1 + SUM\ \Delta Wk - 1$ is available at the output of block 29. This signal is linked in a multiplication point 36 to the signal Tk from the discharge factor characteristic map 26. The transition compensation signal UKk is then available at the output of the multiplication point 36. This signal is subsequently linked, in a summing point 37, to the output signal tlk of the basic characteristic map 25 and then additionally corrected, if required, as a function of lambda ($\lambda$) and as a function of the temperature in a block 38. The output signal of the correction block 38 is then finally available to the injection valve 15 as overall injection signal ti.

There also remains to be mentioned a difference-forming element 39, which receives both the signal on line 35 and the output signal of the multiplication point 36 and forms the second signal to be processed in the next calculation step in block 29.

Figure 3:
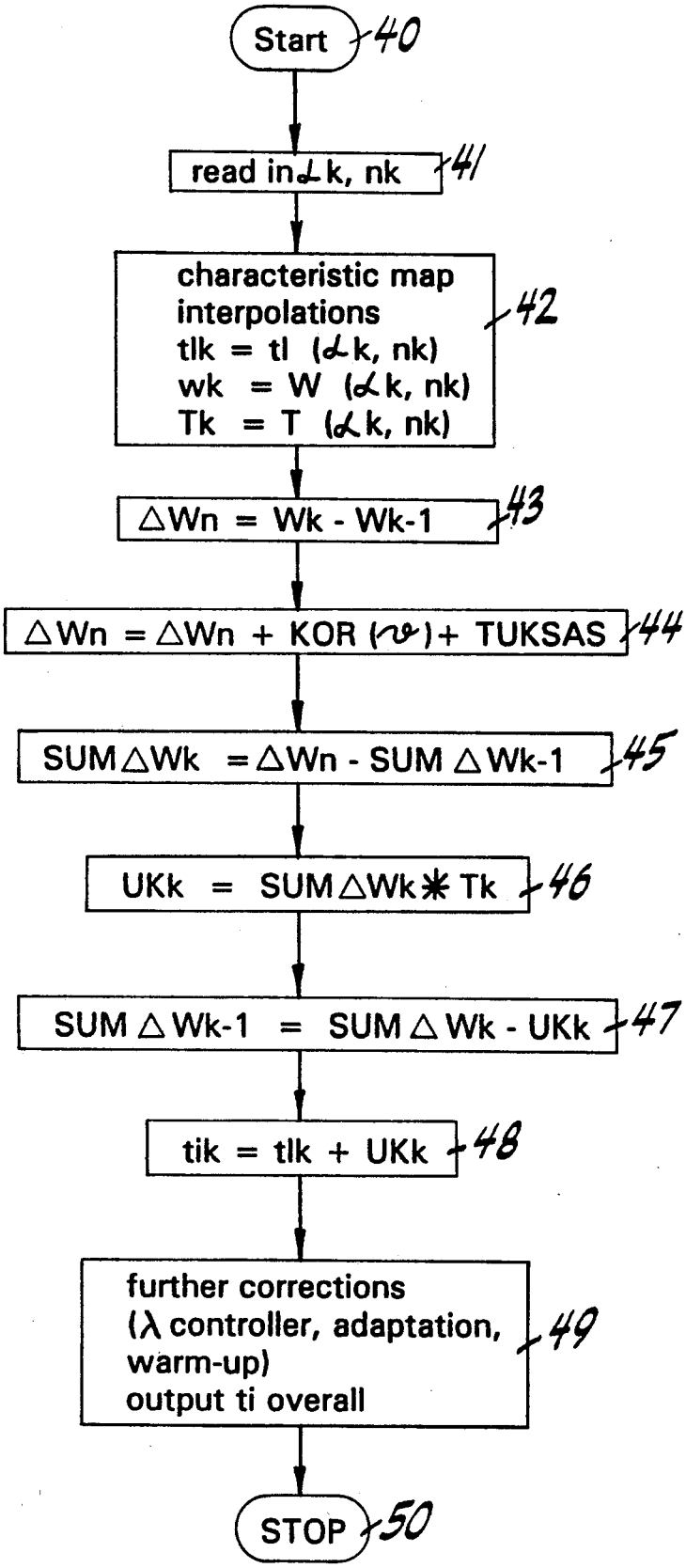
FIG. 3 is a flow diagram of a first embodiment of the method of the present invention for generating a transition compensation signal.

The subject-matter of FIG. 2 is expediently explained by means of a flow diagram illustrated in FIG. 3. The individual calculation steps can proceed either by time intervals or by angular intervals (e.g. in relation to the crankshaft).

In FIG. 3, the starting point is denoted by 40. The reading-in of a load value $\alpha k$ and of a rotational speed value nk follows in block 41. Here, the letter k indicates the values of the individual variables available at instant tk. k-1 denotes the corresponding values in each case at the preceding sampling instant.

Block 41 is followed by a block 42, in which a value for the basic metering signal tlk, for the wall-film fuel quantity Wk, and a discharge factor Tk are read or made available as an already established interpolation value from each of the characteristic maps 25, 26 and 27 familiar from FIG. 2.

In block 43, corresponding to block 28 in FIG. 2, there follows a difference formation between the individual wall-film fuel quantity values at successive sampling instants. In block 44, a correction is made as a function of the temperature and the overrun duration. In the following block 45 the not-yet-injected remainder of the preceding difference SUM $\Delta Wk$-1 is added to this value $\Delta Wn$ formed in block 44, the current wall-film difference $\Delta Wn$. The subsequent block 46 corresponds to the multiplication point 36 of FIG. 2. In it, the value of the instantaneously valid transition compensation signal UKk is determined. There follows, in block 47, the calculation, familiar from the difference-forming point 39 of FIG. 2, of an alteration amount of SUM $\Delta Wk$ for the next calculation step in block 45. Finally, in block 48, the output signal is formed in a manner corresponding to the summing point 37 of FIG. 2, and this may be followed, in the following block 49, by further corrections. Following this, a signal relating to the overall injection duration ti is output and the program run ends with the program step Stop (50).

FIG. 2 and FIG. 3 thus disclose a load- and rotational speed-dependent reading of a wall-film fuel quantity signal from a corresponding characteristic map 27 or 42, respectively, at a sampling instant tk. This wall-film fuel quantity value is redetermined at each sampling instant as a function of the load and the rotational speed, and a difference is determined therefrom. This is followed in block 29 or 44 by taking into account the residual values of earlier wall-film differences.

Depending on the duration of the preceding overrun operation or the respectively prevailing temperature, correction terms are then formed and these lead, finally, to a wall-film fuel quantity signal SUM $\Delta Wk$ on line 35 and in block 47. This value is multiplied by a discharge factor signal Tk from the discharge factor characteristic map 26 or 42 to form an instantaneous valid transition compensation signal UKk, and this transition compensation signal UKk is added to the basic injection-quantity signal tlk from the basic characteristic map 25. Using this signal, the respectively valid wall-film quantity value is thus continuously determined and alterations during formation taken into account as the transition compensation signal.

Figure 4A:
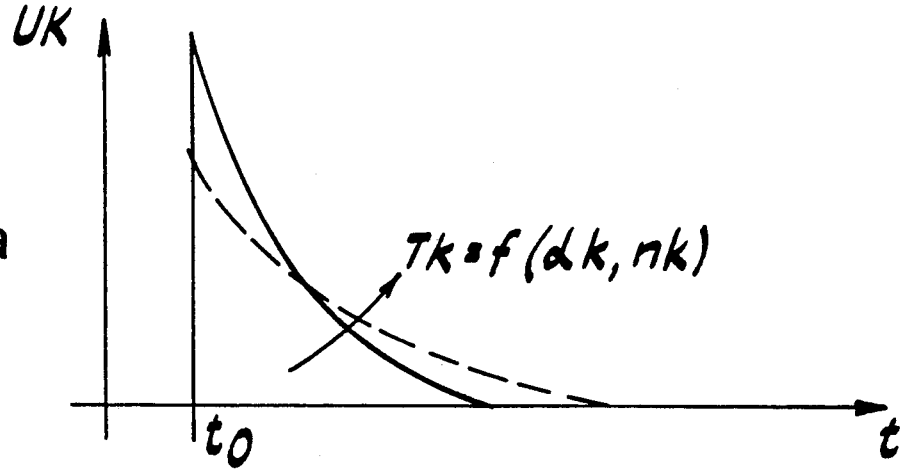
FIG. 4*a* is a graph of a transition compensation signal as a function of time for the implementation of the first embodiment of the method of the present invention set forth in the flow diagram in FIG. 3.

FIG. 4*a* shows an example of the course of transition compensation (UK), as given by the function described in FIGS. 2) and 3). Let it be assumed that an acceleration demand occurs at instant to. The variation in transition compensation with respect to time is determined by the throttle valve- and rotational speed-dependent discharge factor T.

Figure 4B:
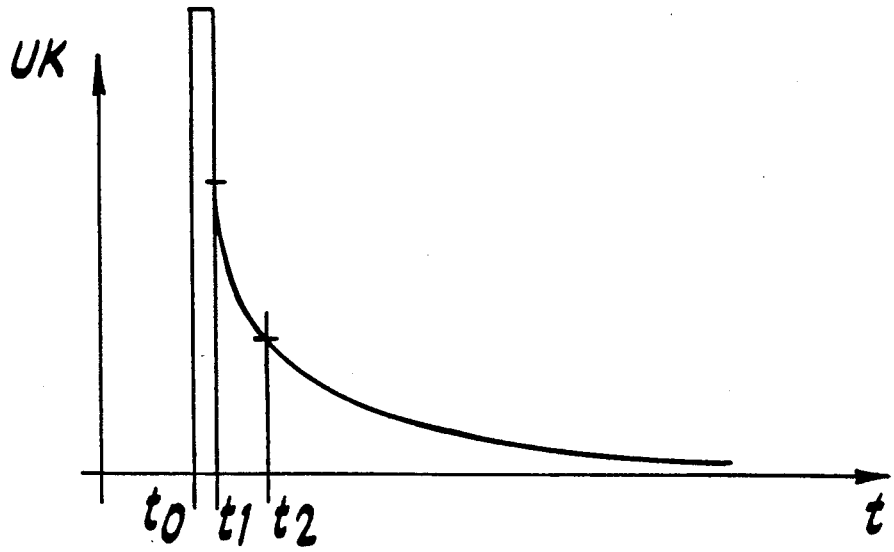
FIG. 4*b* is a graph of a transition compensation signal as a function of time for a second embodiment of the method of the present invention for generating a transition compensation signal.

FIG. 4*b* shows a typical variation in the case of a modified implementation of transition compensation. Immediately after the calculation of the necessary transition compensation, a so-called interim injection is triggered, providing an additional fuel quantity a synchronously to the normal injection. The remaining additional quantity required is distributed between two storage devices. At instant $t_1$, the exponential discharge of these storage devices begins, one storage device being discharged rapidly and the other slowly. From instant $t_2$ on, only the slow discharge is effective. The variation in FIG. 4*b* makes it possible to dispense with the calculation of the discharge factor from a characteristic map. Instead, the characteristic map is replaced by 2 discharge factors which are derived from 2 applicable constants. In order to make the distribution between the rapid and the slow discharge device variable in the case of different rotational-speed/load points, the distribution factor can also be described by a characteristic map against rotational speed and load.

Figure 5A:
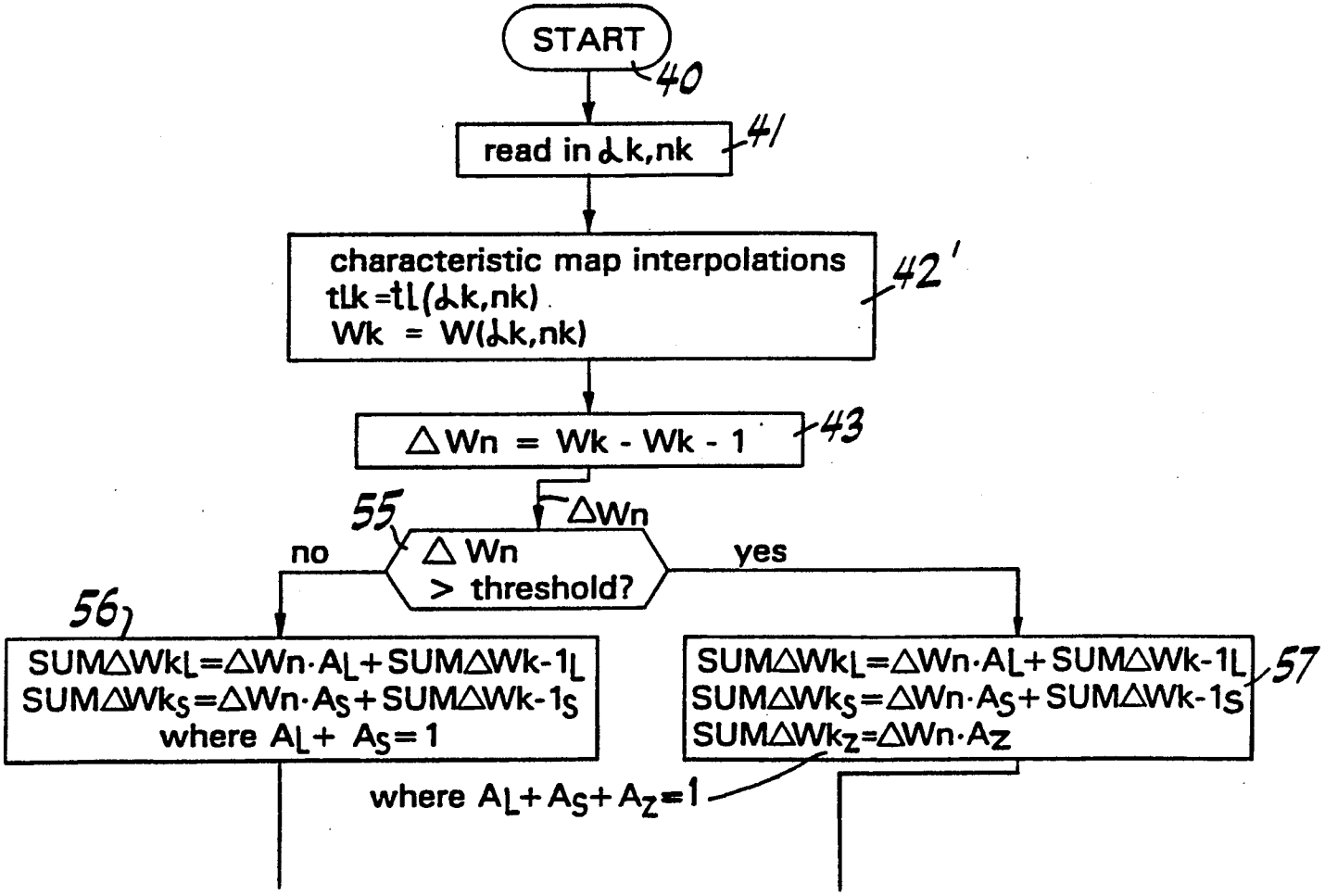
FIGS. 5*a* and 5*b* are flow diagrams of the second embodiment of the method of the present invention for generating a transition compensation signal.
Figure 5B:
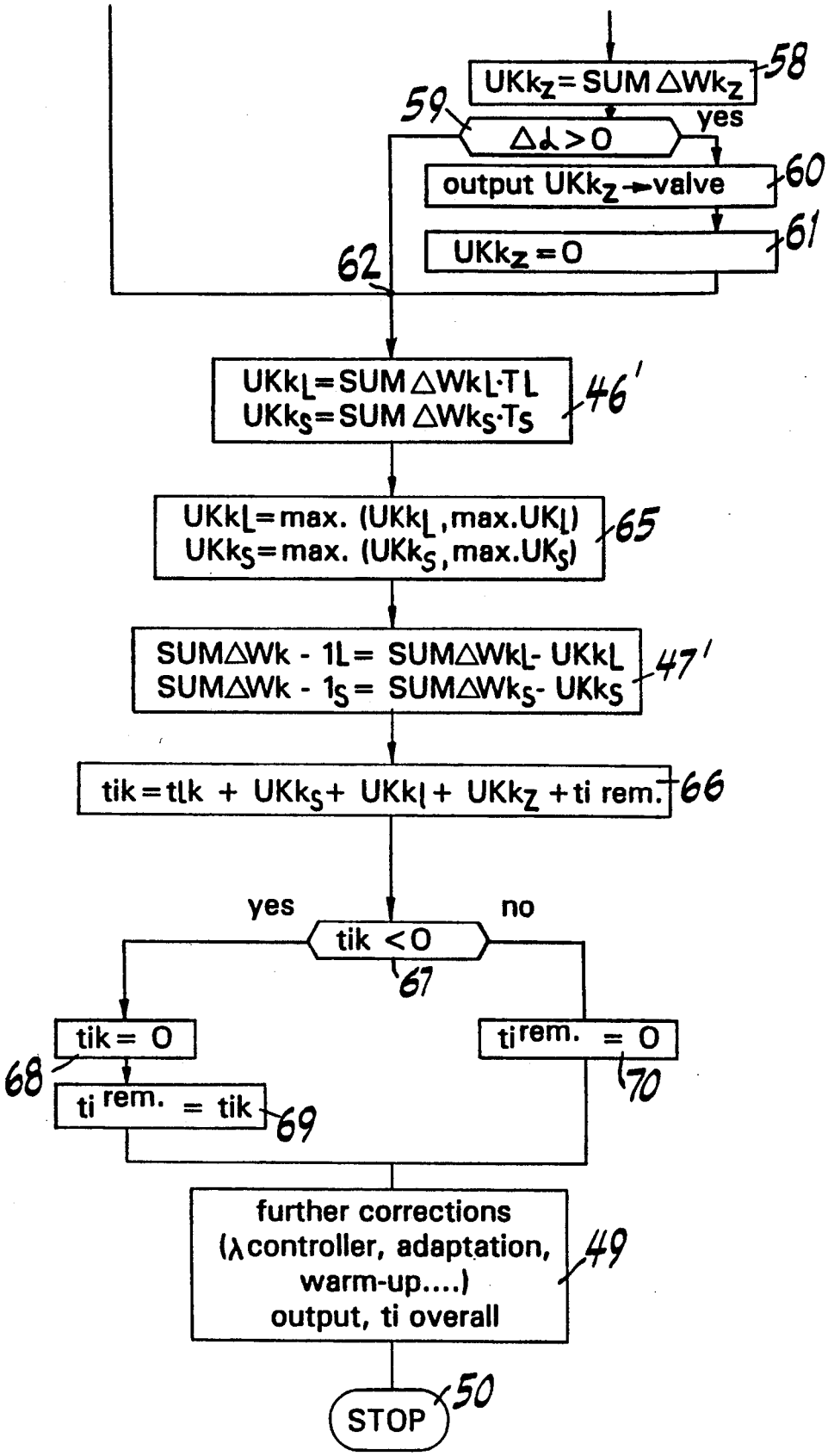

One possibility for the implementation of the signal variation of FIG. 4*b* is shown by FIGS. 5*a* and 5*b*. Here, blocks which correspond to those in FIG. 3 are also provided with the corresponding reference numerals. It can be seen that, in block 42', the formation of a discharge factor signal from a characteristic map is omitted and, henceforth, this factor is subsequently specially formed.

Following the block 43, familiar from FIG. 3, relating to the formation of a current wall-film difference signal $\Delta Wn$, this difference signal is interrogated for a threshold. This interrogation is marked by 55. If the threshold is not reached, then, in a block 56, a calculation of alteration values takes place in accordance with the following formula:

$$\text{SUM } \Delta Wk_L = \Delta Wn.A_L + \text{SUM } \Delta Wk-1_L$$

$$\text{SUM } \Delta Wk_S = \Delta Wn.A_S + \text{SUM } \Delta Wk-1_S$$

where $A_L + A_S = 1$

If, in block 55, an alteration signal greater than a certain threshold value is detected, then a calculation results in block 57 in accordance with the formula stated below:

$$\text{SUM } \Delta Wk_L = \Delta Wn.A_L + \text{SUM } \Delta Wk-1_L$$

$$\text{SUM } \Delta Wk_S = \Delta Wn.A_S + \text{SUM } \Delta Wk-1_S$$

$$\text{SUM } \Delta WK_Z = \Delta Wn.A_Z$$

where $A_L + A_S + A_Z = 1$ $A_L$, $A_S$ and $A_Z$ are applicable factors which distribute the total newly added wall-film difference $\Delta Wn$ between the three storage devices, the long-time, short-time, and interim-injection storage devices.

Following this is a block 58 for forming an interim injection signal ($UKk_Z = \text{SUM } \Delta WkZ$). If a positive alteration in the throttle-valve signal is subsequently detected in an interrogation unit 59, the output of an interim injection ($UKk_z$) takes place in block 60. After the output of this interim injection, the corresponding interim injection signal $UKk_z$ is set to zero in block 61. A junction 62 in the program connects the outputs of the two blocks 56 and 61, and of the interrogation unit 59 relative to the output "negative alteration in the throttle-valve position".

The calculation of the slow discharge ($T_L$) and of the rapid discharge ($T_s$) is carried out jointly for all branches in block 46'. This is followed by a block 65, which limits the transition compensation signals $UKk_L$ and $UKk_S$ to applicable maximum values max. $UK_S$ and max. $UK_L$, respectively. In accordance with the flow diagram of FIG. 3, there follows a block 47', which is followed in turn by a block 66 for the formation of an overall injection-time signal.

In view of the fact that, depending on the transition compensation signal, the overall injection signal tik can also assume negative values, an interrogation 67 follows with respect to a threshold for deciding whether the value is greater or less than 0. If the overall injection signal is less than 0, the injection time is limited to 0 in a block 68 and, at the same time, the negative remainder is taken into account in the next injection.

If the value formed in block 66 is greater than 0, the entire injection signal can be metered in without leaving a certain residual value to be taken into account in the following injection. This finds its expression in block 70. Finally, in block 49, further corrections are performed and the resulting overall injection-quantity signal ti is output.

Significant in the subject-matter of FIG. **4*b* is the fact that alterations in the wall-film quantity are weighted in blocks 56 and 57 using the values $A_L$, $A_S$ and, in the latter case, also $A_Z$ with the aim of a discharge using different time constants in accordance with the illustration in FIG. 4*a***.

We claim:

1. A method for controlling fuel injection of an internal combustion engine of a vehicle during acceleration and deceleration, comprising the steps of:

measuring a load of the engine and generating a load signal;

measuring a rotational speed of the engine and generating a speed signal;

generating a basic fuel-quantity signal, a discharge factor signal, and a wall-film quantity signal based on the load and speed signals;

generating a wall-film quantity alteration signal based on the wall-film quantity signal;

generating a transition compensation signal based on the wall-film quantity alteration signal and the discharge factor signal; and generating a compensated fuel control signal based on the transition compensation signal and the basic fuel-quantity signal.

2. A system for controlling fuel injection of an internal combustion engine of a vehicle during acceleration and deceleration, comprising:

load sensor for measuring a load on the engine and for generating a load signal based thereon;

rotational speed sensor for measuring a rotational speed of the engine and for generating a speed signal based thereon;

first signal processing means for receiving the load signal and the speed signal, and for generating a basic fuel-quantity signal, a discharge factor signal, and a wall-film quantity signal based on the load and speed signals;

second signal processing means for receiving the wall-film quantity signal and for generating a wall-film quantity alteration signal based thereon;

third signal processing means for receiving the wall-film quantity alteration signal and the discharge factor signal, and for generating a transition compensation signal based thereon; and fourth signal processing means for receiving the transition compensation signal and the basic fuel-quantity signal, and for generating a compensated fuel injection signal based thereon.

3. The system according to claim 2, wherein the load sensor includes a throttle valve sensor.

4. The system according to claim 2, wherein the third signal processing means includes means for multiplying the wall-film quantity alteration signal and the discharge factor signal.

5. The system according to claim 2, wherein the third signal processing means includes means for subtracting the transition compensation signal from the wall-film quantity alteration signal for generating a transition compensation signal.

6. The system according to claim 2, wherein the system further comprises means for limiting the transition compensation signal to a preselected maximum value.

7. The system according to claim 2, wherein the system further comprises means for inhibiting fuel injection to the engine if the compensated fuel injection signal generated by the fourth signal processing means has a negative value.

8. The system according to claim 2, further comprising a temperature sensor for measuring a temperature of the engine and for generating a temperature signal based thereon, with the temperature signal being input to the second signal processing means for use as one of the signals for generating the wall-film quantity alteration signal.

9. The system according to claim 8, wherein the second signal processing means includes a subtractor.

10. The system according to claim 9, wherein the system further comprises means for determining a duration of an overrun operation of the engine and for generating an overrun signal based thereon, with the overrun signal being input to the second signal processing means with the temperature signal for correcting the wall-film quantity signal.

11. The system according to claim 2, wherein the second signal processing means includes at least two storage devices.

12. The system according to claim 11, wherein the second signal processing means includes an interim injection storage device.

13. The system according to claim 12, wherein the first signal processing means includes at least one characteristic map.

* * * * *